US005108019A

United States Patent [19]

Woodward et al.

[11] Patent Number: 5,108,019

[45] Date of Patent: Apr. 28, 1992

[54] HANDGUN SAFETY AID

[76] Inventors: Terry D. Woodward; Brenda G. Woodward, both of 6605 Chauncey Dr., Memphis, Tenn. 38115

[21] Appl. No.: 620,743

[22] Filed: Dec. 3, 1990

[51] Int. Cl.[5] ..... F41C 33/02

[52] U.S. Cl. ..... 224/243; 224/911; 340/568

[58] Field of Search ..... 224/243, 244, 911, 912, 224/913; 340/568, 540, 652

[56] References Cited

U.S. PATENT DOCUMENTS 3,530,451 9/1970 Devine ..... 340/539

4,325,506 4/1982 Lindell et al. ..... 224/911

4,768,021 8/1988 Ferraro ..... 340/568

4,829,692 5/1989 Guild .

*Primary Examiner*—Linda J. Sholl

[57] ABSTRACT

A mechanism for storing a hand gun and preventing its unauthorized use. A gun holster has a flexible strap that can be latched to the holster in a position extending over the hammer portion of the gun. When the strap is drawn away from the holster (prior to removal of the gun) an electrical circuit is broken, thereby triggering a battery-operated alarm on the holster. A key-operated lockout switch is provided to enable the gun owner to remove the gun without generating an alarm signal.

5 Claims, 1 Drawing Sheet

HANDGUN SAFETY AID

BACKGROUND AND SUMMARY OF THE INVENTION

This invention relates to a mechanism for storing a handgun and preventing its unauthorized use. The mechanism includes a holster for a handgun, and a flexible strap having one end thereof permanently attached to the holster. The freely movable portion of the strap can be moved over the hammer position of the holstered gun and latched in place on an exposed face portion of the holster, such that the gun cannot be fired when the strap is in the latched position.

An audible battery-operated alarm is mounted within a small housing on the holster. Electrical connections are formed between the alarm and the strap latch mechanism so that when an unauthorized person, e.g. a child, unlatches the strap the alarm generates an audible alarm signal. The objective is to frighten the child into a realization that he/she is not permitted to move the gun out of the holster. The alarm may also prove useful should a person attempt to break into a person's home. The hand gun owner can unlatch the strap from the holster, thereby making the gun available for firing; at the same time the audible alarm may frighten the would-be burglar into leaving the area rather than risk a confrontation with the homeowner.

We are aware of prior art patent 4,829,692 issued to R. Guild, and showing an audible alarm system built into a rifle for generating a signal when the rifle safety mechanism is in the off position. We are not aware of any prior art instances of audible alarms incorporated in, or usable on, gun holsters.

THE DRAWINGS

DESCRIPTION OF A PREFERRED EMBODIMENT OF THE INVENTION

Figure 1:
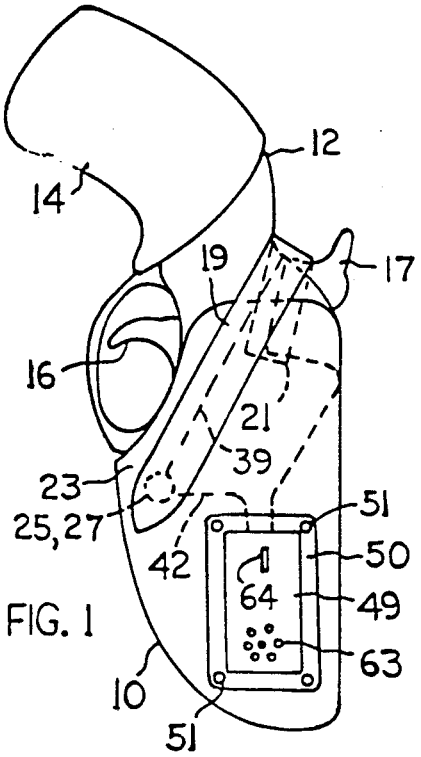
FIG. 1 is a side elevational view of a hand gun holster having an alarm system of the present invention incorporated therein.

FIG. 1 shows a hollow leather holster 10 having an upwardly-open mouth for receiving the barrel portion of a hand gun 12. The gun extends partway into the holster so that handgrip 14, trigger 16 and hammer 17 are exposed, i.e. outside the holster.

A flexible strap 19 has an end portion 21 thereof fixed to the non-illustrated back wall of the holster. The strap is oriented so that its freely-movable main section can be extended over hammer 17 and onto the exposed front wall 23 of the holster, as shown in FIG. 1. With the strap in its FIG. 1 position the gun cannot be fired. Interlocking detent elements 25 and 27 are attached to the free end of strap 19 and the registering area of holster front wall 23, whereby the strap is releasably latched in its FIG. 1 position.

Figure 3:
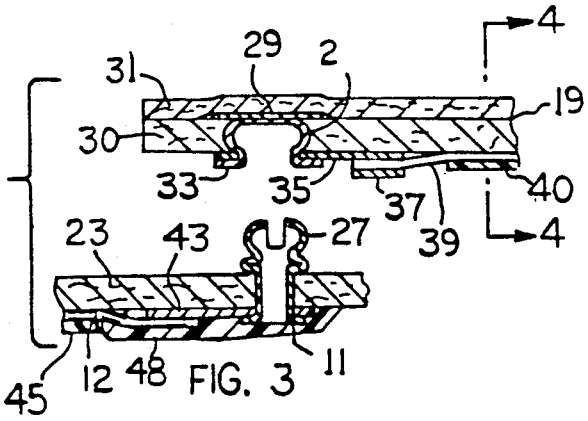
FIG. 3 is a fragmentary sectional view of a detent mechanism that can be used on the FIG. 1 holster to hold a flexible gun-retention strap in a latched position.
Figure 4:
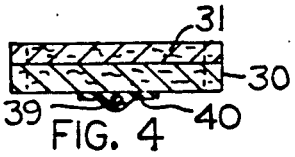
FIG. 4 is a transverse fragmentary sectional view taken on line 4—4 in FIG. 3.

As shown in FIG. 3, detent element 25 is a female snap fastener element extending within a hole in the leather strap; a flat plate 29 is welded or otherwise affixed to element 25 to secure it to the lower (inner) ply 30 of the leather strap. An upper (outer) ply 31 is stitched to ply 30 to conceal plate 29. Flange 33 on detent element 25 grips a flat electrical terminal 35 against the inner face of ply 30. Tabs 37 extend from terminal 35 around an electrically conductive wire 39 that projects from an insulator covering 40. As will be visualized from FIG. 4, the insulated wire can extend along the inner concealed face of strap 19 for its entire length, i.e. to its fixed end 21.

Detent element 27 is a male element having a flange 41 adapted to grip a flat electrical terminal 43 against the inner (concealed) face of the holster wall 23. An electrically conductive wire 42 extends onto the face of terminal 43 where it is welded onto the terminal. The otherwise-exposed terminal 43 has a dielectric plastic encapsulation 48 thereon. Wire 42 will have an electrically insulating cover 45 extending therealong (similar to covering 40).

Wires 39 and 42 will extend along the interior surfaces of strap 19 and holster front wall 23, and thence into a confined space formed by a rectangular housing (or cover) 49. Housing 49 (FIG. 1) is preferably a rigid plastic element having a hollow pan-like configuration facing the surface of holster wall 23. Flanges 50 extend from the housing along wall 23; rivets 51 can be used to secure the plastic housing on wall 23.

Detent elements 25 and 27 are interlockable to releasably hold strap 19 in its FIG. 1 position. The detent elements also act as electrical contacts between wires 39 and 42. An alarm system within housing 49 can be triggered into operation when detent elements 25 and 27 are disengaged, i.e. when strap 19 is lifted away from wall 23 of the holster to remove the handgun.

The alarm system within housing 49 includes a dry cell battery 53, an electrically-energized audible alarm 55 (buzzer, bell, whistle, etc.), and a relay 57. Relay 57 includes a winding 59 and a controlled set of contacts 60. A key-operated switch 62 is in series connection with alarm 55 and contacts 60. The relay winding 59 is in series connection with the separable contacts (detents) 25 and 27.

Figure 2:
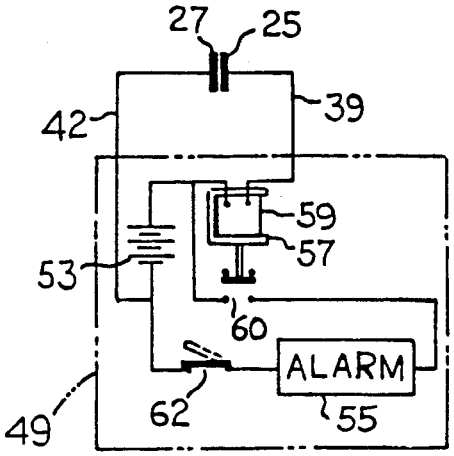
FIG. 2 is a diagram of an electric circuit that can be used in the FIG. 1 alarm system.

In the illustrated condition of the system (FIG. 2) alarm 55 is silent because contacts 60 are in a circuit-open condition. However, should contacts 25 and 27 separate the relay winding 59 will be deenergized to close contacts 60, thereby energizing alarm 55. The audible alarm signal will be directed through a series of sound holes 63 in the wall of housing 49 (FIG. 1).

The alarm system can be locked out (disconnected) by opening switch 62. A key will be inserted through key hole 64 in the wall of housing 49 to operate the switch to its circuit-open position.

Figure 5:
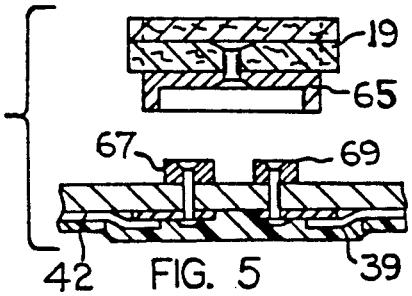
FIG. 5 is a sectional view taken in the same direction as FIG. 3, but illustrating another detent mechanism that can be used in practice of the invention.

FIG. 5 shows an alternate detent construction that can be used. A permanent magnet 65 is carried on strap 19 to bridge two magnets 67 and 69 carried on the holster wall. When magnet 65 is in a latched position engaged with magnets 67 and 69 an electrical circuit is thereby established across wires 39 and 42.

The preferred latch arrangement is shown in FIG. 3. FIG. 5 is a less preferred arrangement because wire 39 is positioned on the holster rather than against strap 19. The FIG. 5 latch system could be defeated by cutting through strap 19. If it were attempted to cut through the strap in the FIG. 3 arrangement the alarm would sound because wire 39 would be severed (thereby interrupting the circuit through winding 59).

The drawings necessarily illustrate particular forms of the invention. It will be understood that the invention can be practiced in other forms.

What is claimed is:

1. A mechanism for storing a hand gun and preventing its unauthorized use, comprising: a holster adapted to receive the barrel portion of a hand gun, with the handgrip, hammer and trigger exposed, whereby the gun can be withdrawn from the holster; a flexible strap having one end thereof anchored to the holster; said strap having a section thereof extendable over the hammer portion of the gun and onto an exposed face portion of the holster, so that the gun cannot be fired when the gun is in the holster; a first detent element carried by the strap in registry with said face portion of the holster; a second detent element carried by said face portion of the holster for engagement with said first detent element, whereby the strap is releasably retained in a position extending over the hammer portion of the gun; a housing carried on the holster; battery means within said housing; an electrically energized alarm means within said housing; and an electrically-operated control means connected to the battery means and the alarm means, whereby the alarm means is energized only when the strap is moved from its position extending over the hammer portion of the gun; said control means including first and second separable electrical contacts formed on said first and second detent elements, so that the control means is triggered into action by the process of disengaging the detent elements.

2. The mechanism of claim 1, wherein said control means comprises a first electrical conductor extending from said housing along the holster and strap into electrical connection with said first electrical contact, and a second electrical conductor extending from said housing along the holster into electrical connection with said second electrical contact.

3. The mechanism of claim 1, wherein said control means comprises an electrical relay located within said housing, said relay having a control winding in series connection with the battery means and separable contacts; said relay having a set of normally-open controlled contacts in series connection with the battery means and the alarm means, whereby the alarm means is energized only when there is no current flow through the relay winding.

4. The mechanism of claim 3, and further comprising a key-operated lockout switch in series connection with the alarm means and relay contacts, whereby the alarm means is disconnected from the battery means when the lockout switch is in the circuit-open position.

5. The mechanism of claim 4, wherein the lockout switch is located within said housing with a key opening extending through an exposed wall of the housing.

* * * * *